US008485003B2

(12) United States Patent
Krebs et al.

(10) Patent No.: US 8,485,003 B2
(45) Date of Patent: Jul. 16, 2013

(54) IRONING APPLIANCE COMPRISING A STEAM CORD PROVIDED WITH A ROTARY CONNECTOR

(75) Inventors: Martin Krebs, Obernburg (DE); Jürgen Wenzlaw, Stuttgart (DE)

(73) Assignee: Rowenta Werke GmbH, Offenbach (DE)

( * ) Notice: Subject to any disclaimer, the term of this patent is extended or adjusted under 35 U.S.C. 154(b) by 945 days.

(21) Appl. No.: 12/526,898

(22) PCT Filed: Feb. 4, 2008

(86) PCT No.: PCT/IB2008/000323

§ 371 (c)(1),
(2), (4) Date: Oct. 14, 2009

(87) PCT Pub. No.: WO2008/099267

PCT Pub. Date: Aug. 21, 2008

(65) Prior Publication Data

US 2010/0031707 A1 Feb. 11, 2010

(30) Foreign Application Priority Data

Feb. 12, 2007 (FR) ..... 07 00983

(51) Int. Cl.
*D06C 7/00* (2006.01)
*A41H 43/00* (2006.01)

(52) U.S. Cl.
USPC ..... 68/222; 38/14; 285/10; 285/11

(58) Field of Classification Search
CPC . D06F 87/00; D06F 75/12; A47L 9/242; A47L 9/24
USPC ..... 68/222; 38/77.8; 285/10, 11
See application file for complete search history.

(56) References Cited

U.S. PATENT DOCUMENTS

| | | | | |
|---|---|---|---|---|
| 3,581,529 | A * | 6/1971 | Mitchell et al. | 68/222 |
| 3,663,023 | A | 5/1972 | Leidenfrost | |
| 4,114,902 | A | 9/1978 | Orlowski | |
| 4,896,396 | A | 1/1990 | Giannelli | |
| 5,094,721 | A * | 3/1992 | Petrek | 203/22 |
| 5,797,162 | A * | 8/1998 | Vystrcil et al. | 15/323 |
| 6,017,037 | A | 1/2000 | Fedorovich | |

(Continued)

FOREIGN PATENT DOCUMENTS

| | | | |
|---|---|---|---|
| EP | 0018647 | A1 | 11/1980 |
| WO | 2005/080665 | A1 | 9/2005 |
| WO | 2005/124010 | A1 | 12/2005 |

*Primary Examiner* — Michael Kornakov
*Assistant Examiner* — Marc Lorenzi
(74) *Attorney, Agent, or Firm* — Browdy and Neimark, PLLC

(57) ABSTRACT

Steam wrinkle-removing appliance including a steam-producing base in which the steam can freely flow out through a hose to a wrinkle-removing tool such as a steam brush, characterized in that the hose is connected to the base by a swivel connector fitted into an adapted housing of the base and in that the steam tightness of the swivel connector is ensured by at least one circular rib (122A, 124) borne by the housing or by the connector, the circular rib (122A, 124) being fitted into a corresponding circular groove (80, 81), respectively provided in the connector or the housing, the width of the groove (80, 81) being slightly greater than the width of the rib so as to result in a gap allowing the connector to rotate freely in the housing.

12 Claims, 3 Drawing Sheets

U.S. PATENT DOCUMENTS 6,151,815 A * 11/2000 Cuzel et al. ..... 38/77.8
6,249,996 B1 * 6/2001 Dorber et al. ..... 38/77.5
6,382,142 B1 * 5/2002 Chen ..... 122/379
2006/0208482 A1 * 9/2006 Guo ..... 285/272

* cited by examiner

IRONING APPLIANCE COMPRISING A STEAM CORD PROVIDED WITH A ROTARY CONNECTOR

BACKGROUND OF THE INVENTION

The present invention relates to a steam wrinkle-removing appliance comprising a base enclosing a steam-producing boiling chamber and connected by a hose to a wrinkle-removing tool, and more particularly relates to the device for connecting the hose to the base.

There is a steam wrinkle-removing appliance, known from the document U.S. Pat. No. 3,581,529, comprising a tank comprising a heating element for bringing the water in the tank to a boil, the tank comprising, in its upper part, a steam outlet in communication with a hose connected to a steam brush. In that document, the end of the hose is connected to the base by means of a connector that is latched into an adapted housing, or housing, of the base by a bayonet connector so that the hose is no longer rotatable once the bayonet is locked.

Such an appliance has the disadvantage of not allowing the hose to rotate freely on the base, so the handling of the steam brush is hampered by the torsional moment generated by the hose.

BRIEF SUMMARY OF THE INVENTION

Thus, one object of the present invention is to propose a wrinkle-removing appliance wherein the steam-transporting hose is connected to the base by means of a connector that allows the hose to rotate freely, and that is simple and economical to produce.

To this end, an object of the invention is a steam wrinkle-removing appliance comprising a steam-producing base in which the steam can freely flow out through a hose to a wrinkle-removing tool such as a steam brush, characterized in that the hose is connected to the base by means of a swivel connector fitted into an adapted housing of the base and in that the steam tightness of the swivel connector is ensured by means of at least one circular rib borne by the housing or by the connector, the circular rib being fitted into a corresponding circular groove, respectively provided in the connector or the housing, the width of the groove being slightly greater than the width of the rib so as to result in a gap allowing the connector to rotate freely in the housing.

Thus, surprisingly, the steam tightness of the connection is ensured by the steam condensates that gradually appear in the vicinity of the grooves and that gradually fill in the gap separating them from the ribs. A feature of this type allows the connector to rotate easily due to the absence of friction at the level of the sealing means.

What is meant by the free flow of steam to the wrinkle-removing tool is the outflow of steam without the interposition of a valve, so that the pressure in the boiling chamber stays low.

According to another feature of the invention, the connector can rotate 360° in its housing.

According to another feature of the invention, the connector comprises a central bore into which fits a connecting tube projecting into the housing.

According to another feature of the invention, the end of the connecting tube forms a rib which is fitted into a groove provided in a shoulder projecting into the central bore of the connector.

According to yet another feature of the invention, the steam tightness of the connection is reinforced by additional ribs provided in the base of the housing and fitted into grooves provided in the bottom face of the connector.

According to another feature of the invention, the connector is removably mounted in the housing of the base.

According to another feature of the invention, the connector is axially immobilized in the housing by a latch which is fitted into a groove provided in the connector.

According to yet another feature of the invention, the latch is brought into the latched position by return means.

According to another feature of the invention, the return means are constituted by an elastically deforming wall.

According to yet another feature of the invention, the base encloses a tank in direct communication with a steam-producing boiling chamber, the boiling chamber comprising a steam outlet allowing the steam to be expelled in the direction of the wrinkle-removing tool, the boiling chamber comprising a heating unit and having a volume that is limited relative to the volume of the tank.

According to yet another feature of the invention, the steam outlet of the boiling chamber is in direct communication with the hose so that the steam produced by the boiling chamber is not diffused into the tank.

According to another feature of the invention, the hose is made of EPDM material.

BRIEF DESCRIPTION OF THE SEVERAL VIEWS OF THE DRAWINGS

The objects, aspects and advantages of the present invention will be more clearly understood from the description given below of a particular embodiment of the invention presented as a non-limiting example, in reference to the attached drawings, in which.

DETAILED DESCRIPTION OF THE INVENTION

Only the elements required to understand the invention have been illustrated. To facilitate the reading of the drawings, the same elements have the same references from one figure to another.

Figure 1:
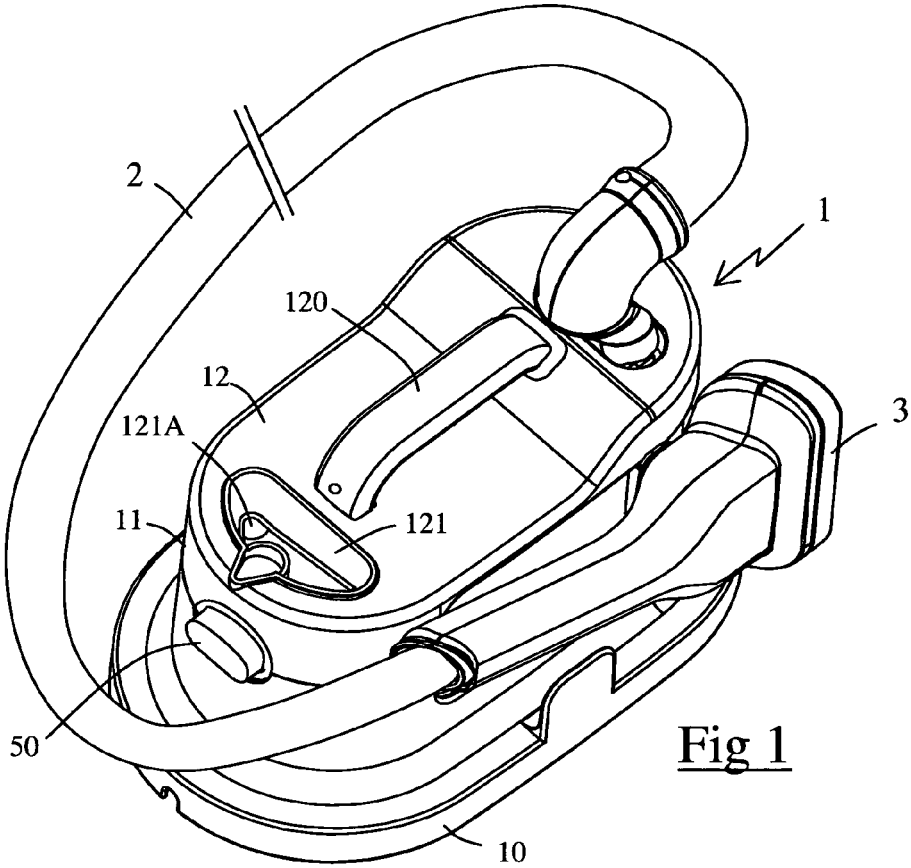
FIG. 1 is a perspective view of a wrinkle-removing appliance according to a particular embodiment of the invention.

FIG. 1 represents a steam wrinkle-removing appliance comprising a steam-generating main unit 1, connected by a hose 2 to a steam brush 3.

Figure 3:
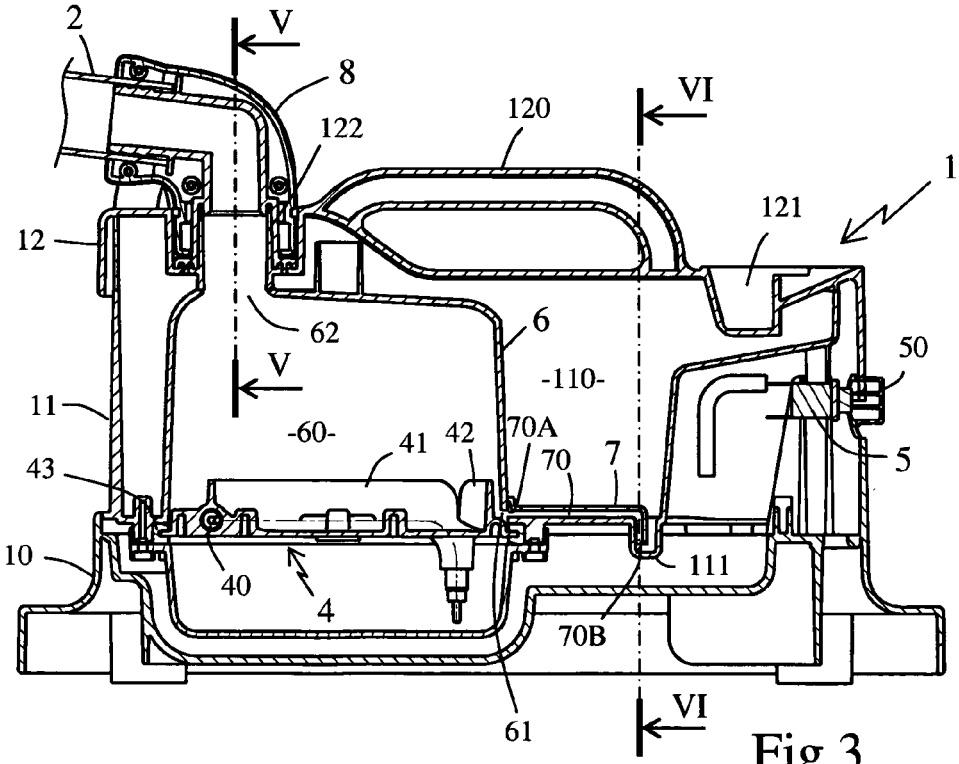
FIG. 3 is a longitudinal sectional view of the appliance of FIG. 1.
Figure 2:
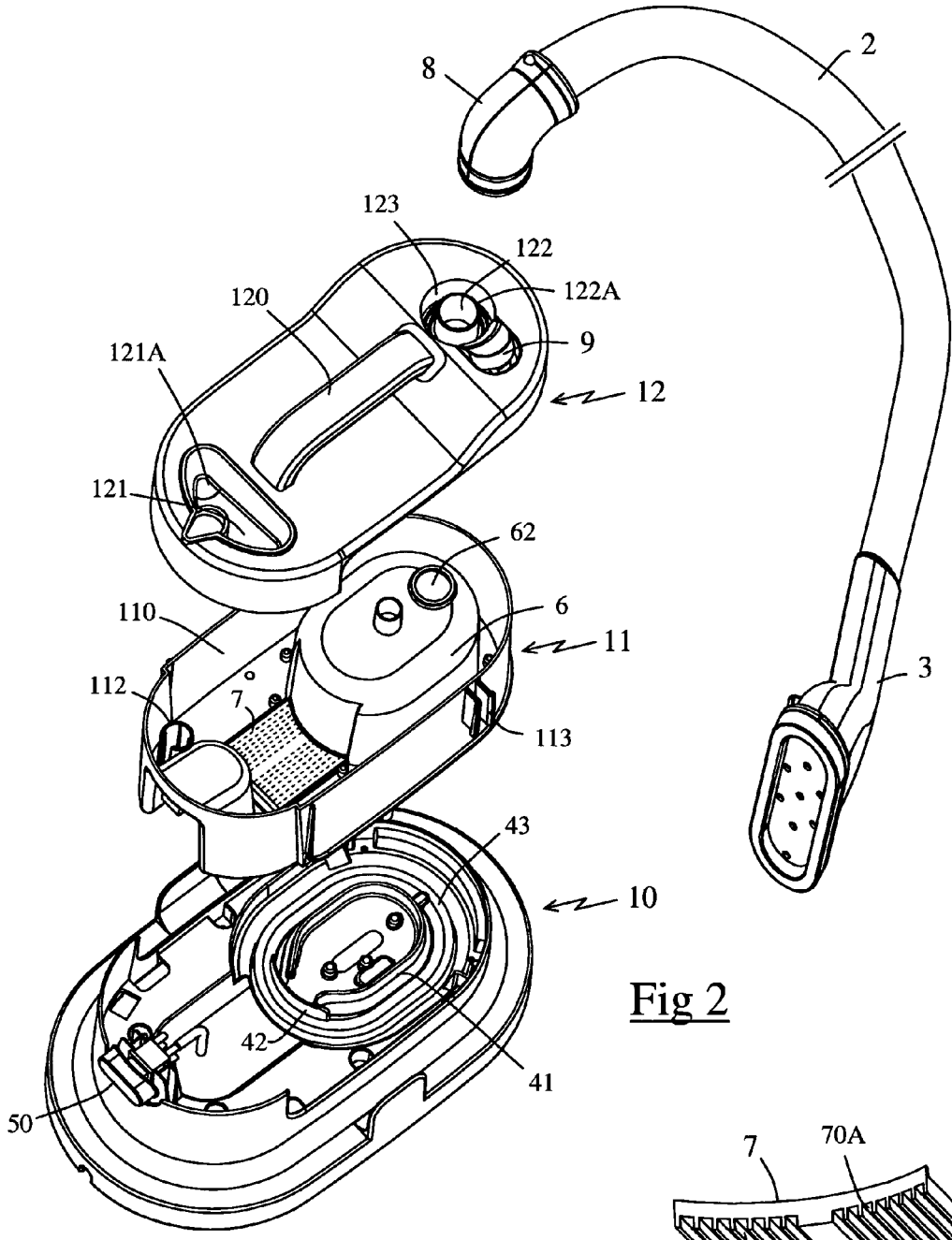
FIG. 2 is an exploded perspective view of the appliance of FIG. 1.

In accordance with FIGS. 2 and 3, the main unit 1 is constituted by the assembly of a base 10, a body 11 and a cover 12, these three elements 10, 11, 12 being firmly joined to each other, for example by gluing or by means of screws, the cover 12 comprising a handle 120 for transporting the appliance.

The base 10 has an oblong outer shape and supports a heating unit 4, advantageously made of aluminum, disposed near a longitudinal end of the base 10, the heating unit 4 enclosing a U-shaped resistor 40, conventionally powered by a circuit equipped with a thermostat, not shown in the figures.

The base 10 also supports a switch 5, actuated by a button 50, which makes it possible to cut off the electric power supply to the resistor 40.

The body 11, which is mounted on the base 10, defines the lateral and bottom walls of a water tank 110 and includes an external clip 113 for securing the steam brush 3 when the appliance is stored.

The body 11 also includes a bell-shaped compartment 6 incorporated into the wall defining the bottom of the tank 110, the compartment 6 having a shape which is adapted so that its lower end comes to rest against a gasket 43 running around the heating unit 4. The compartment 6 thus defines a substantially closed boiling chamber 60 of limited volume, extending above the heating unit 4 and projecting into the middle of the water tank 110, the resistor 40 preferably extending horizontally at the bottom of the boiling chamber 60.

The boiling chamber 60 communicates with the water tank 110 via several supply lines 70 which, in parallel, supply the water for the boiling chamber 60. These channels 70 have a first end 70B opening into the tank 110 and a second end 70A opening into the boiling chamber 60, thus establishing a direct connection between the tank 110 and the boiling chamber 60, this connection allowing the gradual transfer, by gravity, of the water from the tank 110 to the boiling chamber 60.

Figure 4:
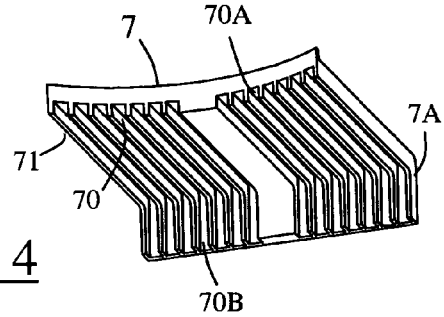
FIG. 4 is a perspective view of the part defining the supply lines of the boiling chamber of the appliance of FIG. 1.
Figure 5:
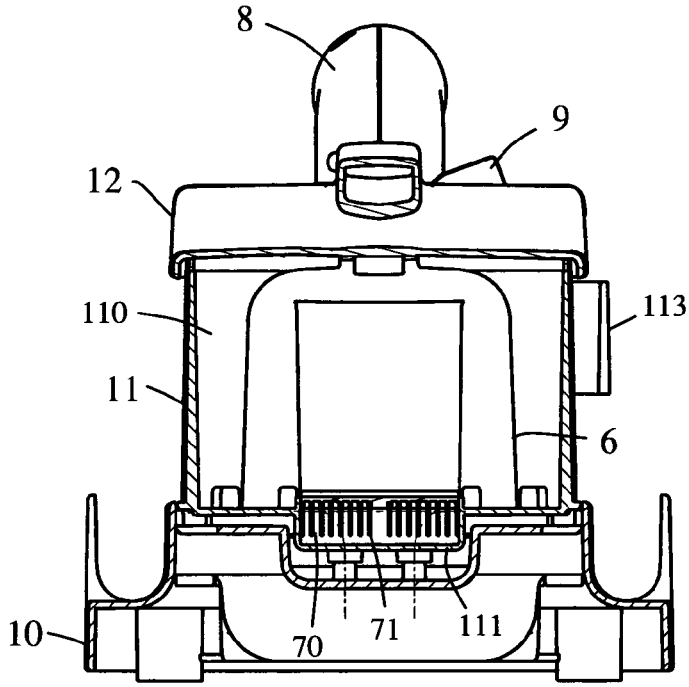
FIG. 5 is a cross-sectional view along line V-V of FIG. 3.

These supply lines 70 are advantageously defined by an insert 7, shown by itself in FIG. 4, comprising a series of ribs 71, parallel to each other, the insert 7 being fitted into an adapted seat in the bottom of the tank 110, placed upstream from an opening 61 formed at the base of the compartment 6.

The supply lines 70 advantageously extend along a length of more than 30 mm, and preferably along a length on the order of 50 mm.

For example, the insert 7 defines fourteen supply lines 70 with an average length on the order of 50 mm, each supply line 70 having a square cross-section of 2.5 mm per side, the small flow cross-section of the supply lines 70, on the order of 6 $mm^2$, having the advantage of limiting the entry of steam bubbles into the supply lines 70.

The length of the supply lines 70, along with their small cross-section, makes it possible to adjust the head losses of the supply lines 70 so as to limit the phenomenon of hot water returning to the tank 110 when the heating unit 4 is in operation as a result of, among other things, the slight excess pressure generated by the heating process inside the boiling chamber 60.

Conversely, increasing the number of supply lines 70 makes it possible to maintain a sufficient flow cross-section to obtain the desired flow of water between the tank 110 and the boiling chamber 60, in order to compensate for the gradual evaporation of the water in the boiling chamber 60.

This prevents the appearance of gaps in the steam, which can appear when the boiling chamber 60 is not sufficiently supplied with water due to the counterflow circulation of the hot water to the tank 110 or to the presence of steam bubbles in the supply circuit.

Preferably, the insert 7 comprises a bent part 7A such that the end 70B of the channels opens into a recess 111 of the tank 110 and is lower than the end 70A opening into the boiling chamber 60, the difference in height between the two ends 70A, 70B of the channels advantageously being greater than 5 mm and preferably on the order of 8 mm.

Such a feature, via a convection phenomenon linked to the existing thermal gradient between the cold water present in the tank 110 and the hot water in the boiling chamber 60, contributes to limiting the return of the hot water to the tank 110, the hot water having a tendency to remain in the upper part of the supply lines 70.

Advantageously, the heating unit 4 comprises a crown 41 extending vertically above the resistor 40, to a height on the order of 8 mm, so as to increase the surface area allowing a heat exchange with the water present in the boiling chamber 60.

The crown 41 has an open end that allows the free circulation of water between the inside and the outside of the crown 41, and the heating unit includes a wall 42 extending vertically in front of this open end, at a distance on the order of 5 mm from the end of the supply line 70 of the boiling chamber 60, the wall 42 forming a barrier which limits the emission of steam bubbles toward the supply lines 70.

The top of the compartment 6 has a steam outlet 62 which is advantageously connected, by means of a connector 8, to the supply hose 2 of the steam brush 3 so that the steam produced by the boiling chamber 60 is sent to the hose 2 without being diffused into the tank 110.

The cover 12 that closes the tank 110 comprises, at the opposite end from the outlet for the hose 2, a cavity 121 equipped with a filling inlet 121A that opens directly into the tank 110, the tank 110 advantageously including a float, not shown in the figures, which slides inside a column 112 disposed underneath the filling inlet 121A so as to seal it when the level in the tank 110 is at its maximum.

Such a tank 110 can thus be filled at any time, even while the appliance is in operation, by pouring water through the filling inlet 121A; the latter does not need to be closed with a cap given the absence of steam inside the tank 110.

Moreover, the fact that the steam is not diffused through the tank 110 makes it possible to prevent the steam produced in the boiling chamber 60 from cooling in contact with the water prior to being diffused into the hose 2. This makes it possible to limit the risk of condensates forming inside the hose 2, these condensates having the disadvantage of forming droplets that can be projected by the flow of steam through the steam brush 3, which has the disadvantage of wetting the fabric and runs the risk of burning the user.

In order to further reduce the risk of condensates forming inside the hose 2, the latter is preferably made from EPDM (Ethylene Propylene Diene Monomer) material in order to obtain good thermal insulation, thus limiting the cooling of the steam during its passage through the hose 2, the latter preferably having a length of more than 1.50 m in order to make it more ergonomical to use. The good thermal insulation provided by the EPDM material also has the advantage of reducing the surface temperature of the hose 2 when the appliance is in operation, and hence the risk of burns through contact with the hose 2.

Figure 6:
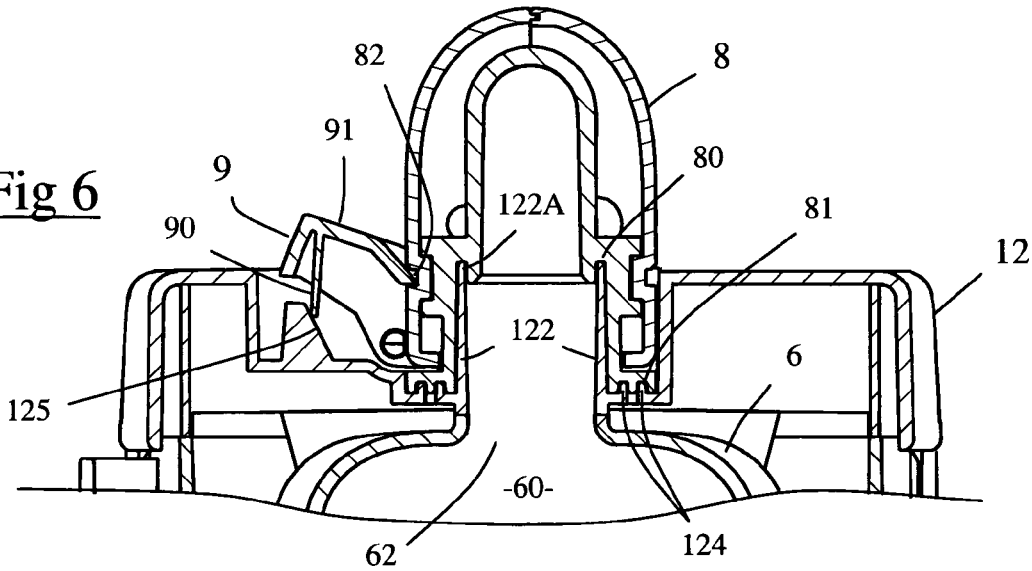
FIG. 6 is an enlarged cross-sectional view along line VI-VI of FIG. 3.
Figure 7:
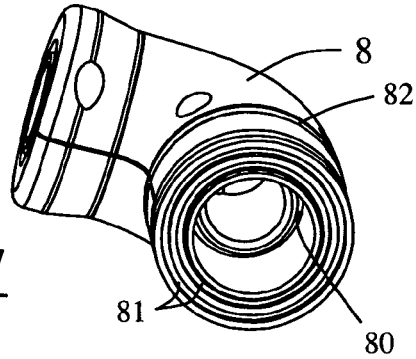
FIG. 7 is a perspective view of the connector, shown by itself.

In accordance with to FIG. 6, the cover 12 includes a connecting tube 122 which surrounds the steam outlet 62, the connecting tube 122 projecting outside the cover 12 in the middle of a circular housing 123 adapted for receiving the connector 8 disposed at the end of the hose 2, the connector 8 comprising a barrel of circular cross-section that allows it to rotate 360° inside the housing 123.

More particularly according to the invention, in order to facilitate the rotation of the connector 8 in its housing, the latter is preferably sealed, not using a gasket but a series of baffles.

To this end, the connector 8 comprises a central bore into which the connecting tube 122 borne by the cover 12 fits, the end of the connecting tube 122 forming a rib 122A which is inserted into a groove 80 provided in a shoulder inside the central bore of the connector 8, this groove 80 cooperating with the end of the connecting tube 122 to form a first sealing barrier.

The seal of the connector 8 is also reinforced by the presence of two circular ribs 124 formed in the bottom of the housing 123, which are fitted into two circular grooves 81 provided in the bottom surface of the connector 8, the grooves 81 having a width, on the order of 0.5 mm, greater than the width of the ribs 124.

This produces a series of baffles, which surprisingly provides a very good seal for the steam connection, particularly owing to the formation of condensates, which fill in the space between the ribs 124 and the grooves 81.

The connector 8 is preferably removably mounted in the housing 123, the barrel of the connector 8 comprising a groove 82 on its outer surface, into which is fitted the end of a latch 9 pivotably mounted on the rim of the housing 123. The latch 9 is brought into a latched position by an elastic wall 90 borne by the latch 9 that comes to rest against an oblique wall 125 borne by the cover 12 so as to form return means.

Such a latch 9 can be brought into an unlatched position simply by pressing on the upper surface 91 of the latch 9 so as to disengage the end of the latch 9 from the groove 82 of the connector, after which the latter can be decoupled from the tube 122 by being lifted out of the housing 123.

An appliance equipped with a hose having such a swivel connector has the advantage of being very convenient to use, allowing the hose to rotate freely relative to the base during the handling of the steam brush, the connector being able to rotate easily in its housing thanks to the absence of a gasket and any friction.

A steam wrinkle-removing appliance of this type also has the advantage of making it possible to obtain steam very quickly once the appliance is turned on, thanks to the presence of the boiling chamber that makes it possible to heat only a volume of water that is reduced relative to the volume of the tank. Moreover, such an appliance has the advantage of allowing a continuous production of steam, the risk of gaps in the steam being considerably reduced due to the fact that the boiling chamber is supplied by numerous supply lines.

Lastly, such a wrinkle-removing appliance, in which the steam leaving the boiling chamber is sent directly into the supply hose of the steam brush without being diffused into the tank, has the advantage of making it possible to introduce high-temperature steam into the hose, thus limiting the risk of condensate formation, and makes it possible to obtain a steam-free tank enclosure that can be filled by the user at any time.

It is understood that the invention is in no way limited to the embodiment described and illustrated, which has been given only as an example. Modifications are possible, particularly with regard to the structure of the various elements or the substitution of technical equivalents, without going outside the scope of protection of the invention.

The invention claimed is:

1. Steam wrinkle-removing appliance comprising a steam-producing base (1) in which the steam can flow out through a hose (2) to a wrinkle-removing tool (3), characterized in that the hose (2) is connected to the base (1) by means of a swivel connector fitted into an adapted housing (123) of said base (1) and in that steam tightness of the swivel connector (8) is ensured by means of a plurality of circular ribs (124) borne by a base of the housing (123), said circular ribs (124) being fitted into a corresponding circular grooves (81), respectively provided in a bottom face of the connector (8), the width of said grooves (81) being greater than the width of said ribs (124) so as to result in gaps allowing the connector (8) to rotate 360° in the housing (123) while also sealing the connector by forming a series of baffles, said baffles allowing the formation of condensates to fill in the gaps.

2. Wrinkle-removing appliance according to claim 1, characterized in that the connector (8) comprises a central bore into which fits a connecting tube (122) projecting into the housing (123).

3. Wrinkle-removing appliance according to claim 2, characterized in that the end of the connecting tube (122) forms a rib (122A) which is fitted into a groove (80) provided in a shoulder projecting into the central bore of the connector (8).

4. Wrinkle-removing appliance according to claim 1, characterized in that the connector (8) is removably mounted in the housing (123) of the base.

5. Wrinkle-removing appliance according to claim 4, characterized in that said connector (8) is axially immobilized in the housing (123) by a latch (9) which is fitted into a groove (82) provided in the connector (8).

6. Wrinkle-removing appliance according to claim 5, characterized in that the latch (9) is brought into a latched position by return means (90).

7. Wrinkle-removing appliance according to claim 6, characterized in that said return means are constituted by a wall (90) that deforms elastically.

8. Wrinkle-removing appliance according to claim 1, characterized in that said base (1) encloses a tank (110) in direct communication with a steam-producing boiling chamber (60), the boiling chamber (60) comprising a steam outlet (62) allowing the steam to be expelled in the direction of the wrinkle-removing tool (3), the boiling chamber (60) comprising a heating unit (4) and having a volume that is limited relative to the volume of the tank (110).

9. Wrinkle-removing appliance according to claim 8, characterized in that the steam outlet (62) of the boiling chamber (60) is in direct communication with the hose (2) so that the steam produced by the boiling chamber (60) is not diffused into the tank (110).

10. Wrinkle-removing appliance according to claim 1, characterized in that the hose (2) is made of EPDM material.

11. Steam wrinkle-removing appliance comprising a steam-producing base (1) in which the steam can flow out through a hose (2) to a wrinkle-removing tool (3), characterized in that the hose (2) is connected to the base (1) by means of a swivel connector fitted into an adapted housing (123) of said base (1) and in that steam tightness of the swivel connector (8) is ensured by means of a plurality of circular ribs (124) borne by the base of the housing (123) and a plurality of circular grooves (81) into which said circular ribs (124) are fitted, said circular grooves being provided in a bottom face of the connector (8), the width of said grooves (81) being greater than the width of said ribs (124) so as to result in a gaps allowing the connector (8) to rotate in the housing (123) when said appliance is in use and steam is flowing out through the hose while also sealing the connector by forming a series of baffles, said baffles allowing the formation of condensates to fill in the gaps.

12. Steam wrinkle-removing appliance according to claim 11, wherein said connector (8) can rotate by 360° in the housing (123).

* * * * *